US005894784A

United States Patent [19]

Bobbitt, III et al.

[11] Patent Number: 5,894,784

[45] Date of Patent: Apr. 20, 1999

[54] BACKUP WASHERS FOR DIAPHRAGMS AND DIAPHRAGM PUMP INCORPORATING SAME

[75] Inventors: John T. Bobbitt, III; Duane C. Johnson; Stephen D. Able, all of Bryan, Ohio

[73] Assignee: Ingersoll-Rand Company, Woodcliff Lake, N.J.

[21] Appl. No.: 09/131,760

[22] Filed: Aug. 10, 1998

[51] Int. Cl.[6] ..... F01B 19/02

[52] U.S. Cl. ..... 92/100; 417/395

[58] Field of Search ..... 417/395; 92/100, 92/94

[56] References Cited

U.S. PATENT DOCUMENTS

| | | | |
|---|---|---|---|
| 1,479,580 | 1/1924 | Barnum et al. . | |
| 1,956,787 | 5/1934 | Birch | 50/23 |
| 2,145,566 | 1/1939 | Corydon et al. | 103/150 |
| 2,414,804 | 1/1947 | Duncan | 102/16 |
| 3,134,571 | 5/1964 | Boteler | 251/331 |
| 3,149,572 | 9/1964 | Davis | 103/37 |
| 3,249,022 | 5/1966 | Bolger, Jr. | 92/100 |
| 3,572,218 | 3/1971 | Gumtow | 92/99 |
| 3,872,777 | 3/1975 | Mastis | 92/101 |
| 4,050,861 | 9/1977 | Sakai et al. | 417/471 |
| 4,203,352 | 5/1980 | Schuster et al. | 92/94 |
| 4,238,992 | 12/1980 | Tuck, Jr. | 92/103.5 D |
| 4,666,378 | 5/1987 | Ogawa | 417/571 |
| 4,993,925 | 2/1991 | Becker et al. | 417/413 |
| 5,378,122 | 1/1995 | Duncan | 417/395 |
| 5,649,813 | 7/1997 | Able et al. | 417/387 |
| 5,707,217 | 1/1998 | Loeffler | 92/100 |
| 5,743,169 | 4/1998 | Yamada | 92/100 |

OTHER PUBLICATIONS

Advertisement "Top–Flex Rubber Diaphragms," WABCO Mold Rubber Products Division Brochure, 1p.

*Primary Examiner*—Charles G. Freay
*Assistant Examiner*—Ehud Gartenberg
*Attorney, Agent, or Firm*—Leon Nigohosian, Jr.

[57] ABSTRACT

A backup washer for clamping a diaphragm having a flexible washer disposed next to a rigid washer, the flexible washer including a material less stiff than a material of the rigid washer. The flexible washer may include an elastomer material such as rubber. A flexible washer having a varied stiffness profile may also be provided to the face by incorporating materials having different stiffnesses, contouring, or both. The rigid washer may include a metal, plastic, composite materials, or combinations of these and may also be bowed or ribbed. The flexible washer and rigid washer of the backup washer may mechanically fastened, bonded, or molded together. A diaphragm pump having a diaphragm which is clamped by at least one backup washer having a flexible washer which includes a material less stiff than the material of the diaphragm and a rigid washer next to the flexible washer which includes a material more stiff than the diaphragm material.

19 Claims, 4 Drawing Sheets

BACKUP WASHERS FOR DIAPHRAGMS AND DIAPHRAGM PUMP INCORPORATING SAME

This invention relates to backup washers for diaphragm pumps, and more particularly for air operated diaphragm pumps.

Double diaphragm pumps are known in the art and are widely used in pumping a wide variety of materials. Examples are shown in U.S. Pat. Nos. 4,585,832; 4,936,753; and 5,391,060, the disclosures of which are incorporated herein by reference. Shown in FIG. 1 is a typical double diaphragm pump 2 having two pumping cavities formed between an air cap 4 and a fluid cap 6. Each cavity includes a fluid chamber 8 and an air chamber 12 which are separated by a pumping diaphragm 10 spanning the width of the cavity with the diaphragms being interconnected by a connecting rod 11. Each fluid chamber 8 is connected to an intake valve 14 and exhaust valve 16, with (i) intake valve 14 connected through an-intake manifold 15 to a source of fluid or other material to be pumped through the pump and (ii) the exhaust valve 16 connected to an exhaust manifold 17. By introducing pressurized air into one air cap 4, the pressure acts on the diaphragm spanning the air cap causing the diaphragm to move toward its fluid cap 6. This displaces the fluid being pumped from the fluid chamber 8 and forces it to travel out the exhaust valve 16 and exhaust manifold 17. As the diaphragm moves, it pulls connecting rod 11 which, in turn, pulls the other diaphragm away from its corresponding fluid cap and toward its corresponding air cap, thereby drawing fluid into the other fluid chamber through its intake valve and manifold 15. At the end of the stroke, the pressurized air cap is exhausted and the exhausted air cap is pressurized, reversing the motion. Thus, the double diaphragm pump accomplishes a nearly constant flow of pumping through the pump by continuously driving the connecting rod back and forth in the pump.

The critical driving element of diaphragm pump 2 is diaphragm 10 which is a generally circular membrane typically made of a relatively flexible material, e.g., rubber or a thermoplastic elastomer (TPE), and having an outer peripheral portion 20 that is clamped or otherwise held in a stationary position against the pump housing. Such diaphragms also include a centrally located portion 21 and a working portion 22 that joins the central and peripheral portions. The central portion 21 is typically clamped between a pair of rigid backup washers 24, 25 and secured by a threaded bolt 9 which passes through centrally located holes in the backup washers and the diaphragm into the end of connecting rod 11 as shown. Rigid backup washers 24, 25 are typically metal castings that provide rigid support for diaphragm 10 during operation of diaphragm pump 2. The working and central portions of the diaphragm are displaced in a reciprocating manner as described above to drive liquid out of the pump. The useful life of a diaphragm is limited, however, and failure of the diaphragm can result in the contamination and/or damage of the pump equipment by the material being pumped. Such failures can require considerable time and expense for cleaning, repair, or both. A diaphragm failure may also cause the release of chemicals being pumped to an air stream that subsequently gets released into the environment where it may result in further damage or injury.

The foregoing illustrates limitations known to exist in present devices. (Thus it is apparent that it would be advantageous to increase the useful life of pump diaphragms. Accordingly backup washers and diaphragm pumps are provided including the features more fully disclosed hereinafter.

SUMMARY OF THE INVENTION

According to the present invention, a backup washer for clamping a diaphragm is provided having a flexible washer disposed next to a rigid washer wherein the flexible washer includes a material less stiff than a material of the rigid washer. The flexible washer may include an elastomer material such as rubber. The face of the flexible washer may be contoured to shape the diaphragm throughout a pumping cycle. A flexible washer having a varied stiffness profile may also be provided to the face by incorporating materials having different stiffnesses, contouring, or both. The rigid washer may include a metal, plastic, composite materials, or combinations of these and may also be bowed or ribbed. The flexible washer and rigid washer of the backup washer may be mechanically fastened, bonded, or molded together. Holding of the backup washer may include a flexible washer of rubber molded to a rigid washer which includes a pressed metal.

Also provided is diaphragm pump having a diaphragm which is clamped by at least one backup washer according to the present invention. The diaphragm pump may include a second diaphragm and backup washer having flexible and rigid washers for clamping the diaphragm and may further include additional diaphragms and backup washers according to the present invention.

The foregoing and other aspects will become apparent from the following detailed description of the invention when considered in conjunction with accompanying drawing figures.

BRIEF DESCRIPTION OF THE DRAWING FIGURES

DETAILED DESCRIPTION OF THE PREFERRED EMBODIMENTS

Figure 1:
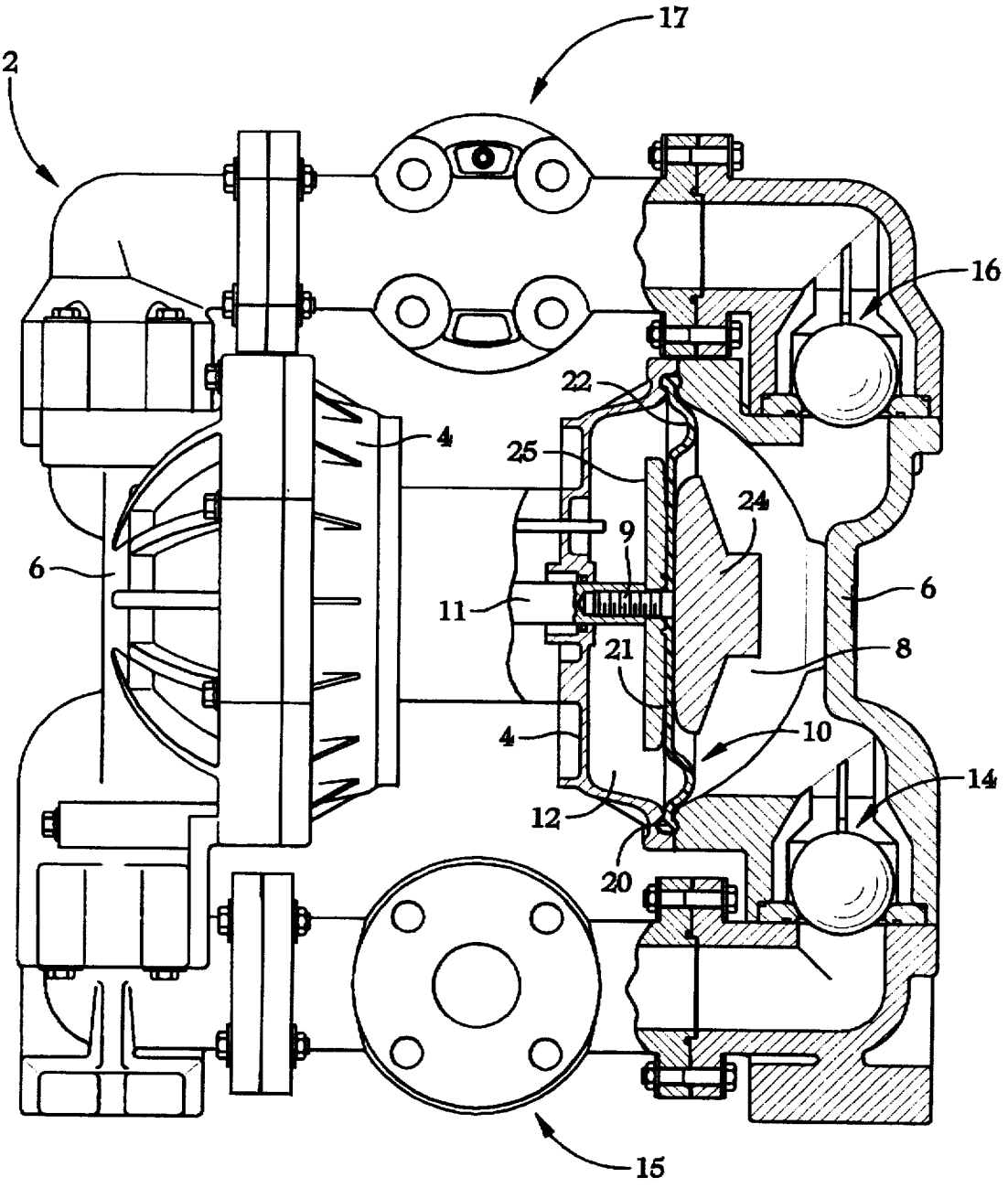
FIG. 1 (PRIOR ART)
FIG. 1 is a partial sectional view of a conventional diaphragm pump.
Figure 2:
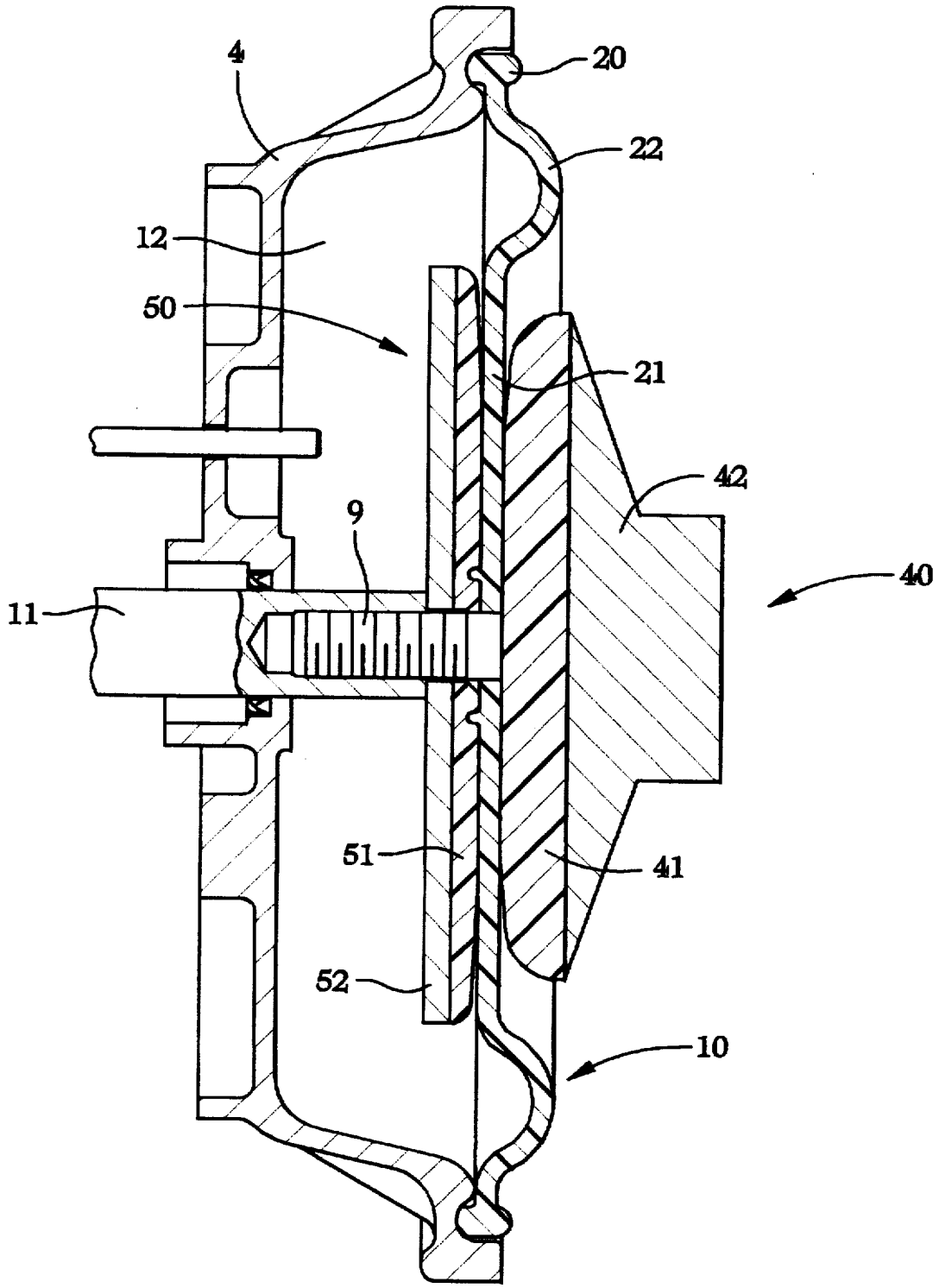
FIG. 2 is a sectional view of pump diaphragm shown mounted between a pair of backup washers according to one embodiment of the present invention.

As used herein, the term "diaphragm" means a flexible barrier that divides two fluid containing chambers or compartments. Typically, such barriers are useful with diaphragm pumps, however, these diaphragms may also be employed as a barrier layer between two compartments in any application where a fluid exists in one compartment and would cause deleterious effects if present in the other compartment.

The invention is best understood by reference to the accompanying drawings in which like reference numbers refer to like parts. It is emphasized that, according to common practice, the various dimensions of the diaphragms and the associated pump parts as shown in the drawings are not to scale and have been enlarged for clarity.

Figure 3:
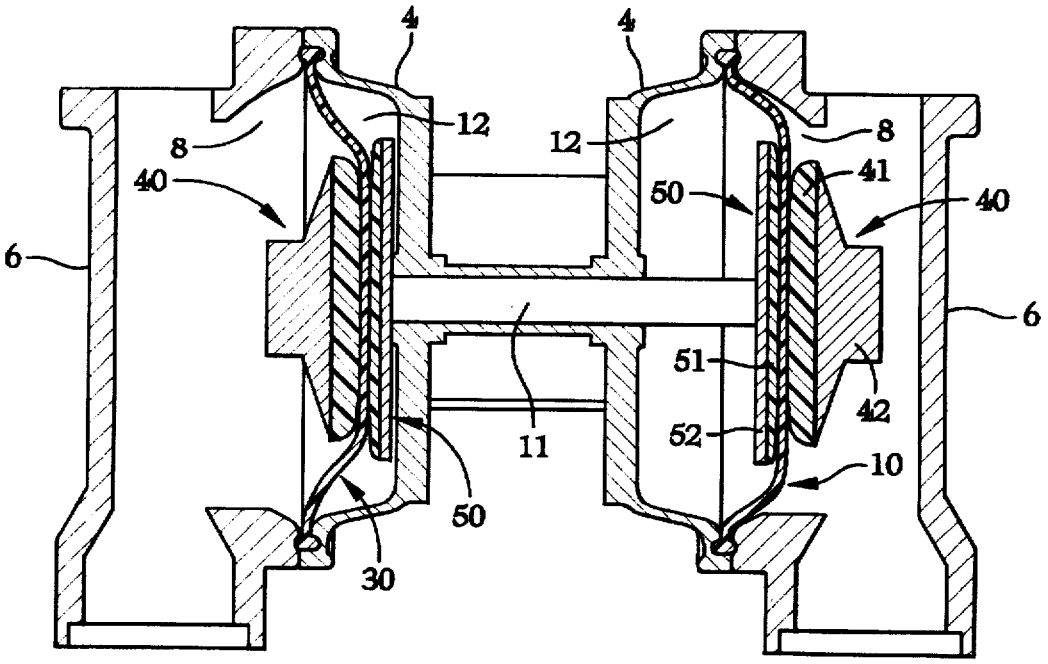
FIGS. 3–5 are cross-sectional schematic views of two diaphragms each mounted between a pair of backup washers shown in FIG. 2 moving through successive stages of a pumping stroke within a diaphragm pump according to the present invention.
Figure 4:
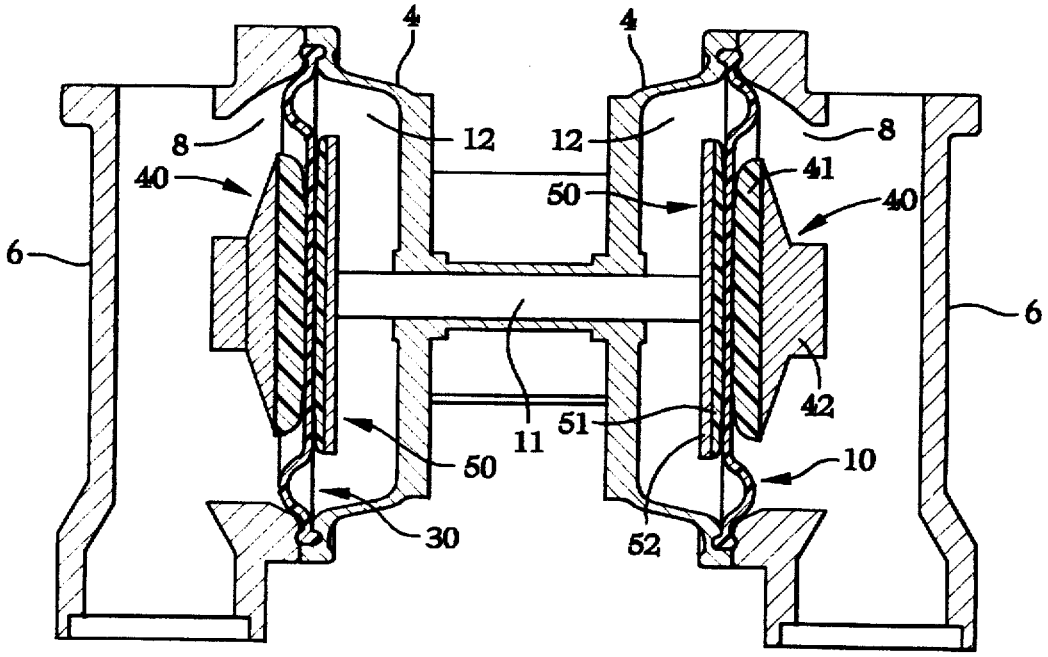
Figure 5:
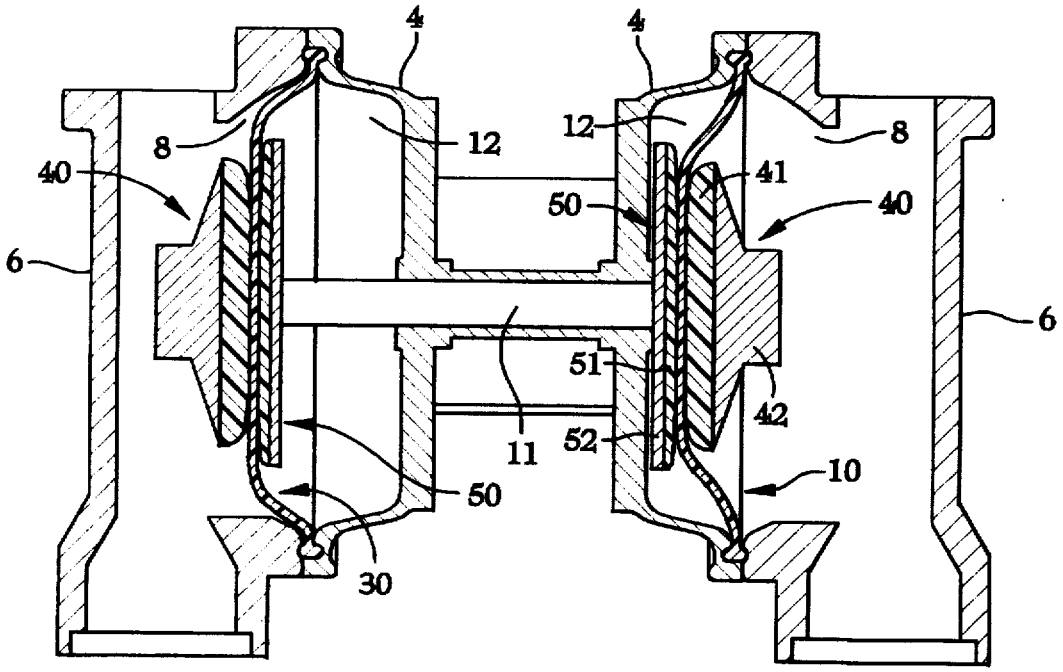

Referring now to the drawings, shown in FIGS. 3–5 are cross-sectional schematic views that illustrate the motion of two diaphragms 10 and 30 as they move through successive stage of a pumping stroke within the fluid chambers 8 and air chambers 12 of a diaphragm pump. Operation of the pump is as described above with respect to the diaphragm pump 2 shown in FIG. 1 and is accomplished by first introducing pressurized air to diaphragm 30 causing it to exert force on the fluid chamber and expel the fluid within. This motion also causes diaphragm 10 to draw fluid into its respective fluid chamber. When diaphragms 10, 30 and connecting rod 11 have traveled through the position shown in FIG. 4 to the predetermined distance shown in FIG. 5, pressurized air is then introduced to diaphragm 10 to reverse the motion back through the positions shown in FIG. 4 and then back to FIG. 3. By alternating the introduction of pressurized air to diaphragms 10 and 30 in this manner, the pumping motion of the diaphragm pump is continuously repeated.

Shown in FIGS. 2–5 are two backup washers 40 and 50 according to the present invention which, unlike the conventional clamping backup washer design of the diaphragm pump of FIG. 1, incorporate a combination of flexible and rigid materials layers. Backup washers 40 and 50 according to one embodiment of the present invention each include a flexible washer 41, 51 disposed next to a rigid washer 42,52, respectively, as best illustrated by the exploded view of FIG. 2. This combination provides the stiffness required to maintain diaphragm shape throughout the pump cycle, yet provides a relatively soft, flexible interface created between the flexible washers and diaphragms. As defined herein, the terms "flexible" and "rigid" are not intended to define any specific material or particular classes of materials but refer to the relative difference in stiffness between the materials employed. All that is required is that the "flexible" materials used for flexible washers 41 and 51 are less stiff than the rigidity presented by the "rigid" material or materials used for the rigid washers 42 and 52, respectively, so that the flexible washers are caused to flex by the rigid washers during operation of the pump. Exemplary materials for use in the flexible washers are rubber or other elastomer materials while metals, rigid plastics, composite materials, and combinations of these materials may be used in the rigid washers.

Although not intending to be bound to or otherwise limited by any theory, it is believed that, by this construction, a hybrid backup washer is provided by the present invention which will reduce localized stresses placed on the diaphragm at the outer edge of the backup washer. As a result, it is expected that wear created by the constant flexing of the diaphragms against conventional rigid backup washers such as those shown in FIG. 1, will be reduced thereby leading to longer diaphragm life.

In addition to improved diaphragm life, the backup washers may also be used to enhance the pump performance, the seal quality between the washers and the diaphragm, or both. As can be seen in FIGS. 3–5, the face of each of flexible washers 41 and 51 which abut diaphragms 10 and 30 define the shape that the diaphragms take throughout the pumping cycles which, in turn, controls the performance characteristics of the pump. By further varying the stiffness profile presented by the flexible washers, additional control may be provided to optimize the diaphragm shape and therefore pump performance. Additionally, the stiffness profile presented by the flexible washer may be optimized to better seal the air cap from the fluid cap by preventing leakage across threaded bolt 9. This may be accomplished by increasing the stiffness profile of the flexible washer to increase the clamping force in the central portion 21 of the diaphragm. By increasing the clamping force exerted by the flexible washer on central portion 21, the diaphragm is crushed in this area to provide a seal around the bolt which is thereby enhanced. The various stiffness profiles of the flexible washers described above may achieved by varying the materials used, the contour profiles, or both in the different regions of the flexible washers 41 and 51.

Figure 6:
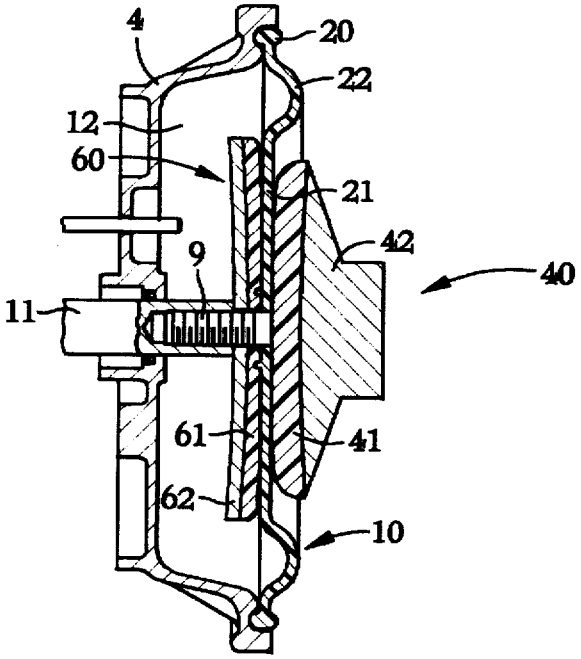
FIG. 6 is a sectional view of pump diaphragm shown mounted between a pair of backup washers according to another embodiment of the present invention.

According to another embodiment of the present invention, it is envisioned that a backup washer 60 having a rigid washer 62 that is bowed may be provided as shown in FIG. 6 to vary the displacement contour of and thereby cause a different stiffness profile to be exerted by a flexible washer 61 on diaphragm 10. It is expected that this would reduce the stress exerted on diaphragm 10 by the outer peripheral edge of flexible washer 61 without the need to vary the substantially flat and constant thickness profiles of the flexible washer.

In yet another embodiment, rigid washer could also be otherwise shaped instead of, or in addition to, providing a bowed profile. For example, rigid washer may be ribbed to provide additional stiffness in which case the flexible washer could either conform to the ribs, or could remain flat and be locally unsupported.

Construction of the backup washers according to the present invention may be accomplished by mechanically abutting and fastening separate flexible and rigid washers together. Alternatively, the backup washers may be manufactured as an integral unitary construction by bonding or otherwise molding the flexible and rigid washers together. Another benefit to be realized by the backup washers of the present invention is reduced manufacturing costs and weight. Current conventional designs are either relatively large castings or expensive machinings. This is required because of the potential for high loads and the complicated surface required for the diaphragm interface to insure an adequate fluid seal. It is envisioned that the present invention will permit an inexpensive rubber molding to be mated to an inexpensive pressing, which may be a steel stamping. Moreover, low cost high strength alloys can be used in the pressings to minimize weight while retaining, or even adding strength.

Although described above with respect to incorporating pairs of backup washers, as will be readily recognized that it would also be possible to use a backup washer on only one side of a diaphragm in conjunction with a conventional rigid washer, such as those shown in FIG. 1, on the other. Moreover, it is also envisioned that additional backup washers according to the present invention may be incorporated into pumps having more than two diaphragms. Additionally, although described with respect to use in an air operated diaphragm pump, it is contemplated that the backup washers according to the present invention may be incorporated into other types of pumps (e.g., electric or hydraulically operated pumps) or in a variety of applications requiring a diaphragm to be moved by a washer.

While embodiments and applications of this invention have been shown and described, it will be apparent to those skilled in the art that many more modifications are possible without departing from the inventive concepts herein described. For example, although hybrid backup washers are shown and described having discrete rigid and flexible washers, it is envisioned that either or both these washers may include and be made up of a plurality of material layers having different stiffnesses to vary the stiffness profile of the washers. It is understood, therefore, that the invention is capable of modification and therefore is not to be limited to the precise details set forth. Rather, various modifications may be made in the details within the scope and range of equivalents of the claims without departing from the spirit of the invention.

Having described the invention what is claimed is:

1. A diaphragm pump comprising:

at least one diaphragm;

first and second backup washers for clamping said at least one diaphragm, each backup washer comprising a flexible washer and a rigid washer disposed next to said flexible washer, said flexible washer comprising a material less stiff than a material of said rigid washer, wherein each flexible washer of said backup washers is in contact with said at least one diaphragm and each rigid washer of said backup washers is rigidly secured to a reciprocating rod of said pump.

2. The diaphragm pump according to claim 1, wherein said flexible washer comprises an elastomer material.

3. The diaphragm pump according to claim 2, wherein said elastomer material is rubber.

4. The diaphragm pump according to claim 1, wherein said rigid washer comprises a material selected from the group consisting of metal, plastic, composite materials, and combinations thereof.

5. The diaphragm pump according to claim 1, wherein said flexible washer further comprises a face for abutting said diaphragm, said face being contoured to shape said diaphragm throughout a pumping cycle.

6. The diaphragm pump according to claim 1, wherein said flexible washer further comprises a face for abutting said diaphragm, said face being contoured to increase a clamping force caused by said flexible washer against a central portion of said ddiaphragm.

7. The diaphragm pump according to claim 1, wherein said flexible washer further comprises a face for abutting said diaphragm, said face having a varied stiffness profile.

8. The diaphragm pump according to claim 7, wherein said face of said flexible washer comprises materials having different stiffnesses to effect said varied stiffness profile.

9. The diaphragm pump according to claim 7, wherein said face of said flexible washer is contoured to effect said varied stiffness profile.

10. The diaphragm pump according to claim 7, wherein said face of said flexible washer comprises materials having different stiffnesses and is contoured to effect said varied stiffness profile.

11. The diaphragm pump according to claim 1, wherein said rigid washer is bowed.

12. The diaphragm pump according to claim 1, wherein said rigid washer is ribbed.

13. The diaphragm pump according to claim 1, wherein said flexible washer and said rigid washer are mechanically fastened together.

14. The diaphragm pump according to claim 1, wherein said flexible washer and said rigid washer are bonded together.

15. The diaphragm pump according to claim 1, wherein said flexible washer and said rigid washer are molded together.

16. The diaphragm pump according to claim 15, wherein said flexible washer is rubber molded to said rigid washer which comprises a pressed metal.

17. The diaphragm pump according to claim 1 further comprising a second diaphragm and third and fourth backup washers for clamping said second diaphragm comprising:

a flexible washer and a rigid washer disposed next to said flexible washer, said flexible washer comprising a material less stiff than a material of said rigid washer, wherein each flexible washer of said third and fourth backup washers is in contact with said second diaphragm and each rigid washer of said third and fourth backup washers is rigidly secured to said reciprocating rod of said pump.

18. The diaphragm pump according to claim 1, wherein said diaphragm pump is selected from the group consisting of an air, an electric, and a hydraulically operated diaphragm pump.

19. The diaphragm pump according to claim 17, wherein said diaphragm pump is selected from the group consisting of an air, an electric, and a hydraulically operated diaphragm pump.

* * * * *